US008369763B2

(12) United States Patent
Sakakibara et al.

(10) Patent No.: US 8,369,763 B2
(45) **Date of Patent: *Feb. 5, 2013**

(54) IMAGE HEATING APPARATUS AND PRESSURE ROLLER USED FOR IMAGE HEATING APPARATUS

(75) Inventors: Hiroyuki Sakakibara, Yokohama (JP); Norio Hashimoto, Odawara (JP); Hiroaki Sakai, Mishima (JP); Atsushi Iwasaki, Susono (JP); Yuko Sekihara, Tokyo (JP); Kazuo Kishino, Yokohama (JP); Masaaki Takahashi, Yokohama (JP); Katsuhisa Matsunaka, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/492,142

(22) Filed: Jun. 8, 2012

(65) Prior Publication Data

US 2012/0257913 A1 Oct. 11, 2012

Related U.S. Application Data

(60) Continuation of application No. 13/154,600, filed on Jun. 7, 2011, now Pat. No. 8,224,223, which is a division of application No. 12/145,104, filed on Jun. 24, 2008, now Pat. No. 8,005,413.

(30) Foreign Application Priority Data

Jun. 26, 2007 (JP) ..... 2007-167477
Jun. 20, 2008 (JP) ..... 2008-162559

(51) Int. Cl.
*G03G 15/20* (2006.01)
*F28F 5/02* (2006.01)

(52) U.S. Cl. ..... 399/331; 482/46

(58) Field of Classification Search ..... 399/328, 399/330–334, 320, 107, 122; 219/216; 492/46
See application file for complete search history.

(56) References Cited

U.S. PATENT DOCUMENTS

| | | | |
|---|---|---|---|
| 6,002,910 | A | 12/1999 | Eddy et al. |
| 6,108,906 | A | 8/2000 | Fujita et al. |
| 6,704,537 | B2 | 3/2004 | Takeuchi et al. |
| 7,171,148 | B2 | 1/2007 | Mitsuoka et al. |
| 7,193,181 | B2 | 3/2007 | Makihira et al. |
| 7,215,916 | B2 | 5/2007 | Kishino et al. |
| 7,242,895 | B2 | 7/2007 | Inada et al. |
| 7,283,145 | B2 | 10/2007 | Kato et al. |
| 7,305,208 | B2 | 12/2007 | Inoue et al. |

(Continued)

FOREIGN PATENT DOCUMENTS

| | | |
|---|---|---|
| JP | 11-116806 | 4/1999 |
| JP | 11-158377 | 6/1999 |

(Continued)

*Primary Examiner* — David Porta
*Assistant Examiner* — Faye Boosalis
(74) *Attorney, Agent, or Firm* — Fitzpatrick, Cella, Harper & Scinto

(57) ABSTRACT

A pressure roller forms a nip for contacting a heating member to pinch and convey a heat recording material. The roller includes a core metal and an elastic layer containing filler. The elastic layer containing the filler includes thermal conductive filler with a length of not less than 0.05 mm and not more than 1 mm with a thermal conductivity $\lambda_f$ in the longitudinal direction in a range of $\lambda_f \geqq 500$ W/(m·k), being dispersed in not less than 5 vol % and not more than 40 vol %. The elastic layer containing the filler has a thermal conductivity $\lambda_y$ in the longitudinal direction perpendicular to a recording material conveyance direction, of $\lambda_y \geqq 2.5$ W/(m·k) and an ASKER-C hardness of the filler is not more than 60 degrees. A solid rubber elastic layer with a thermal conductivity $\lambda$ in a thickness direction of not less than 0.16 W/(m·k) and not more than 0.40 W/(m·k) is included.

16 Claims, 8 Drawing Sheets

U.S. PATENT DOCUMENTS

| | | | |
|---|---|---|---|
| 7,321,746 | B2 | 1/2008 | Sakakibara et al. |
| 7,366,455 | B2 | 4/2008 | Iwasaki et al. |
| 7,493,074 | B2 | 2/2009 | Komuro |
| 2002/0114649 | A1 | 8/2002 | Ohuchi |
| 2007/0065191 | A1 | 3/2007 | Iwasaki et al. |
| 2007/0147915 | A1 | 6/2007 | Kishino et al. |
| 2007/0223979 | A1 | 9/2007 | Jinzai et al. |
| 2008/0273904 | A1 | 11/2008 | Nishida et al. |

FOREIGN PATENT DOCUMENTS

| | | |
|---|---|---|
| JP | 2000-39789 | 2/2000 |
| JP | 2001-349324 | 12/2001 |
| JP | 2002-268423 | 9/2002 |
| JP | 2002-351243 | 12/2002 |
| JP | 2003-190870 | 7/2003 |
| JP | 2003-208052 | 7/2003 |
| JP | 2004-290853 | 10/2004 |
| JP | 2005-156826 | 6/2005 |
| JP | 2005-273771 | 10/2005 |

IMAGE HEATING APPARATUS AND PRESSURE ROLLER USED FOR IMAGE HEATING APPARATUS

This is a continuation of U.S. patent application Ser. No. 13/154,600, filed Jun. 7, 2011, pending, which is a divisional of U.S. patent application Ser. No. 12/145,104, filed Jun. 24, 2008, which issued as U.S. Pat. No. 8,005,413 on Aug. 23, 2011.

BACKGROUND OF THE INVENTION

1. Field of the Invention

The present invention relates to a pressure member suitable for use in a heat fixing apparatus to be mounted on an image forming apparatus selected from the group consisting of an electrophotographic copier and an electrophotographic printer and relates to an image heating apparatus including the pressure member.

2. Description of the Related Art

A heat fixing apparatus to be mounted on a printer of an electrophotographic system and a photocopier of a heat roller system includes a halogen heater, a fixing roller heated by the halogen heater, and a pressure roller brought into contact to the fixing roller to form a nip portion. In addition, a heat fixing apparatus of a film heating system includes a heater including a heat generating resistance body on a substrate made of ceramics, a fixing film contacting the heater to move, and a pressure roller forming a nip portion with the heater through the fixing film.

When a printer on which a fixing apparatus of the above described heat roller system is mounted prints a small sized recording material continuously at the same print interval as the interval in the case of large sized recording material, a phenomenon in which the temperature rises too much in a region (non-sheet feeding region) where recording material does not pass (temperature rises in the non-sheet feeding region) in a longitudinal direction of a fixing nip portion occurs. When the temperature rises too much in the non-sheet feeding region, respective parts configuring the fixing apparatus can be damaged. In addition, printing a large sized recording material in the state where the temperature rises too much in the non-sheet feeding region, causes a region of the recording material corresponding to the non-sheet feeding region to be heated more than necessary. Therefore, high-temperature offset will take place.

In particular, in the case of a film heating type heater capable of using a low heat capacity ceramic heater as a heating body, the heat capacity of the heating body is smaller than the heat capacity of the heat roller system. Therefore, the temperature significantly rises in the non-sheet feeding portion of the heating body and the endurance of the pressure roller deteriorates and high temperature offset is likely to occur. In addition, problems such as film drive instability and film wrinkling are likely to occur.

In addition, as the process speed of the printer gets faster, the temperature is likely to rise too much in the non-sheet feeding region. The reason is that an intensive increase in speed is accompanied by a shortening in the time for the recording material to pass the nip portion and, therefore, the fixing temperature required for heat fixing a toner image onto the recording material cannot be prevented from being made higher. In addition, the phenomenon that the time when no recording material is present in the nip portion during a continuous print step (the so-called sheet absent time) decreases, accompanies an intensive increase in speed of the printer and, therefore, the unevenness of temperature distribution is hardly averaged during the time when the recording material is present between sheets.

As a unit for reducing the temperature rise in the non-sheet feeding portion, a technique of enhancing thermal conductivity of a pressure roller is generally known. An advantage of this approach is that an improvement in heat transfer in an elastic layer which the pressure roller includes can give rise to a decrease in the temperature rise in the non-sheet feeding portion, that is, the difference in heat in the longitudinal direction of the pressure roller decreases.

Japanese Patent Application Laid-Open No. H11-116806, Japanese Patent Application Laid-Open No. H11-158377 and Japanese Patent Application Laid-Open No. 2003-208052 disclose that highly thermal conductive filler selected from the group consisting of alumina, zinc oxide and silicon carbide is added to base rubber in order to improve thermal conductivity of the elastic layer of the fixing roller and pressure roller.

Japanese Patent Application Laid-Open No. 2002-268423 discloses a method of causing an elastic layer to contain carbon fiber in order to improve thermal conductivity of a rotator (not a pressure roller but a fixing belt, though) including an elastic layer.

Japanese Patent Application Laid-Open No. 2000-39789 discloses an invention of causing an elastomer layer to contain anisotropic filler such as graphite for improving thermal conductivity in the roller thickness direction.

Japanese Patent Application Laid-Open No. 2002-351243 discloses an invention of providing a layer of fabric with pitch based carbon fiber in an elastic layer of a pressure roller.

Japanese Patent Application Laid-Open No. 2005-273771 discloses an invention of dispersing pitch based carbon fiber across a pressure roller elastic layer.

However, even if filler selected from the group consisting of alumina, zinc oxide, silicon carbide, carbon fiber and graphite as described in a publication selected from the group consisting of Japanese Patent Application Laid-Open No. H11-116806, Japanese Patent Application Laid-Open No. H11-158377, Japanese Patent Application Laid-Open No. 2003-208052, Japanese Patent Application Laid-Open No. 2002-268423 and Japanese Patent Application Laid-Open No. 2000-39789, is added to an elastic layer for an increase in thermal conductivity, the desired thermal conductivity cannot be obtained in the case of the addition of a small amount of filler. In addition, in the case of the addition of a large amount of filler, the hardness of the pressure roller gets too large to obtain a desired nip width required for heat fixing a toner image onto recording material, giving rise to a problem. As described above, intensification of thermal conductivity and intensification of hardness of the pressure roller have been hardly established together.

A pressure roller disclosed in Japanese Patent Application Laid-Open No. 2002-351243 is extremely excellent in thermal conductivity. However, due to one of the fabric and the fabric based configuration thereof, the hardness of a highly thermal conductive rubber compound layer will increase. In that case, in order to decrease the hardness of the entire pressure roller, foamed sponge rubber is suitably used for an elastic layer in a lower layer. Accordingly, since the elastic layer in the lower layer is configured by a foamed sponge, there is room for an improvement in endurance thereof during consumption.

In addition, the pressure roller disclosed in Japanese Patent Application Laid-Open No. 2005-273771 is excellent in thermal conductivity in the longitudinal direction of the roller and a suitable hardness of the roller can be attained, but the heat transfer from the elastic layer to core metal is so high that the roller surface temperature gets too low. In the case where the pressure roller surface temperature is too low, steam appearing where recording material passes a heating nip forms dew on the pressure roller surface to cause instability in the conveyance of the recording material.

SUMMARY OF THE INVENTION

The present invention was developed in view of the above described problems. An object of the above described is to provide a pressure roller used in an image heating apparatus capable of suppressing a temperature rise in a region, where recording material does not pass, and an image heating apparatus including the pressure roller.

Another object of the present invention is to provide a pressure roller capable of suppressing a temperature rise in a portion, where recording material does not pass, assuring endurance of a pressure roller and the establishment of the stability of recording sheet conveyance and an image heating apparatus including the pressure roller.

A further object of the present invention is to provide a pressure roller comprising a core metal and an elastic layer containing filler. The elastic layer contains the filler including thermal conductive filler with length of not less than 0.05 mm and not more than 1 mm and with thermal conductivity $\lambda_f$ in the longitudinal direction in a range of $\lambda_f \geqq 500$ W/(m·k) and dispersed in not less than 5 vol % and not more than 40 vol %. The elastic layer contains the filler providing a thermal conductivity $\lambda_y$ in the longitudinal direction perpendicular to a recording material conveyance direction of $\lambda_y \geqq 2.5$ W/(m·k), the ASKER-C hardness of the filler being not more than 60°. A solid rubber elastic layer with a thermal conductivity $\lambda$ in a thickness direction of not less than 0.16 W/(m·k) and not more than 0.40 W/(m·k) is included, the solid rubber elastic layer is formed on an outer periphery of the core metal, and the elastic layer containing the filler is formed on the outer periphery of the solid rubber elastic layer, to form a nip portion for contacting to a heating member to pinch and convey and heat recording material.

A further object of the present invention is to provide an image heating apparatus comprising a heating member for heating an image formed on recording material and a pressure roller for forming a nip portion in cooperation with the heating member. The recording material is conveyed in the nip portion. The pressure roller comprises a core metal and an elastic layer containing filler. The elastic layer contains a thermal conductive filler with a length of not less than 0.05 mm and not more than 1 mm and with thermal conductivity $\lambda_f$ in the longitudinal direction in a range of $\lambda_f \geqq 500$ W/(m·k), and is dispersed in not less than 5 vol % and not more than 40 vol %. The elastic layer also contains the filler providing thermal conductivity $\lambda_y$ in the longitudinal direction perpendicular to a recording material conveyance direction of $\lambda_y \geqq 2.5$ W/(m·k) and an ASKER-C hardness of not more than 60°. A solid rubber elastic layer with thermal conductivity $\lambda$ in a thickness direction of nor less than 0.16 W/(m·k) and not more than 0.40 W/(m·k) is included, the solid rubber elastic layer is formed on an outer periphery of the core metal, and the elastic layer containing the filler is formed on the outer periphery of the solid rubber elastic layer.

The further object of the present invention will become more apparent from the following detailed description with reference to the accompanying drawings.

DESCRIPTION OF THE EMBODIMENTS

First Embodiment (1) Example of Image Forming Apparatus

Figure 1:
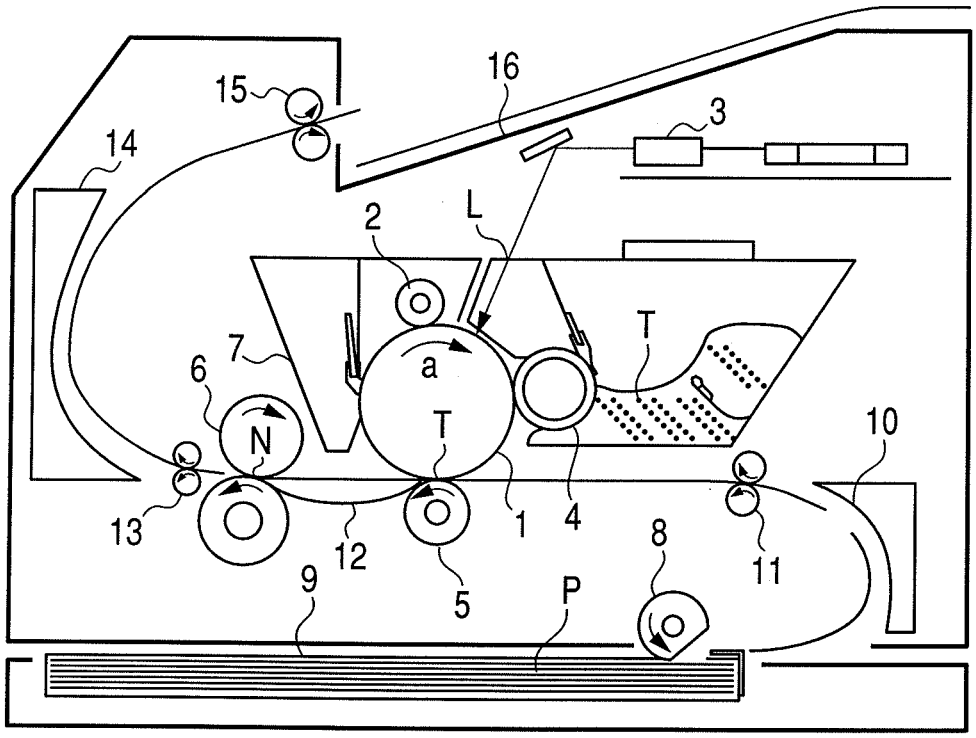
FIG. 1 is a schematic configuration diagram of a model of an example of an image forming apparatus.

FIG. 1 is a schematic configuration mode diagram of an example of an image forming apparatus capable of mounting an image heating apparatus related to the present invention as a heat fixing apparatus. The image forming apparatus is a laser beam printer of an electrophotographic system.

A printer illustrated for the present embodiment includes an electrophotographic photosensitive body of a rotation drum type (to be referred to as photosensitive drum below) 1 as an image bearing member. A photosensitive drum 1 is configured by forming a photosensitive material layer such as OPC, amorphous Se and amorphous Si on an outer periphery surface of a cylindrical (drum-like) a conductive base member made of material selected from the group consisting of aluminum and nickel.

The photosensitive drum 1 is driven to rotate at a predetermined circumferential velocity (process speed) in a clockwise direction of an arrow a and the outer periphery surface (front surface) of the photosensitive drum 1 undergoes a charging process uniformly during the procedure of the rotation to attain predetermined polarity and potential with a charging roller 2 as a charging unit. The uniform charging surface on the surface of the photosensitive drum 1 undergoes scan exposure L with a laser beam being output from a laser beam scanner 3 and modulated and controlled (ON/OFF controlled) corresponding to image information. As a result, an electrostatic latent image corresponding to the image information of an object is formed on the surface of the photosensitive drum 1.

The latent image is developed and visualized by using toner T by a developing apparatus 4 as a developing unit. The developing step selected from the group consisting of the jumping development method, the 2-component development method, and the FEED development method is used and frequently used in combination with image exposure and inversion development.

On the other hand, one sheet of recording material P housed inside a sheet feeding cassette 9 is discharged each time by driving a feeding roller 8 and is conveyed to a registration roller 11 through a sheet path including a guide 10 and the registration roller 11. The recording material P is fed at a predetermined control timing to a transferring nip portion T between the surface of a photosensitive drum 1 and the outer periphery (surface) of a transferring roller 5 by the registration roller 11. The fed recording material P is pinched and conveyed at the transferring nip portion T. A toner image on the surface of the photosensitive drum 1 is sequentially transferred onto the surface of the recording material P by a transferring bias applied to the transferring roller 5 during the conveyance procedure. As a result, the recording material P bears a toner image which is not yet fixed.

The recording material P bearing a toner image which is not yet fixed is sequentially separated from the surface of the photosensitive drum 1 and is discharged from the transferring nip portion T and is introduced into the nip portion N of a heat fixing apparatus 6 through a conveyance guide 12. The recording material P having been introduced to the nip portion N receives heat and pressure by the nip portion N of the fixing apparatus 6 so that the toner image is heated and fixed onto the surface of the recording material P.

The recording material P coming out from the fixing apparatus 6 is printed and discharged to a discharge tray 16 via a sheet path including a conveyance roller 13, a guide 14 and a discharging roller 15.

In addition, the surface of the photosensitive drum 1 after separation of the recording material undergoes processing for removing adhesive contaminator, such as residual toner, subjected to transferring to form a cleaned surface by a cleaning apparatus 7 as a cleaning unit and is used for repeated image forming operations.

A printer of the present embodiment is a printer accepting A3 (297 mm×4200 mm) sized sheets at a print speed of 50 sheets/minute (for the longitudinal side of A4 (210 mm×97 mm sized sheets). In addition, the toner includes styrene acryl resin as a main material with a glass transition point of 55 to 65° C. obtained by one of internally adding and externally adding material selected from the group consisting of a charge controlling agent, a magnetic material and silica.

(2) Fixing Apparatus 6

In the following description, a longitudinal direction of a fixing apparatus and a member configuring the fixing apparatus refers to a direction perpendicular to a recording material conveyance direction on the surface of the recording material, the direction of the shorter side is a direction parallel to the recording material conveyance direction on the surface of the recording material, and the width is a dimension in the direction of the shorter side.

Figure 2:
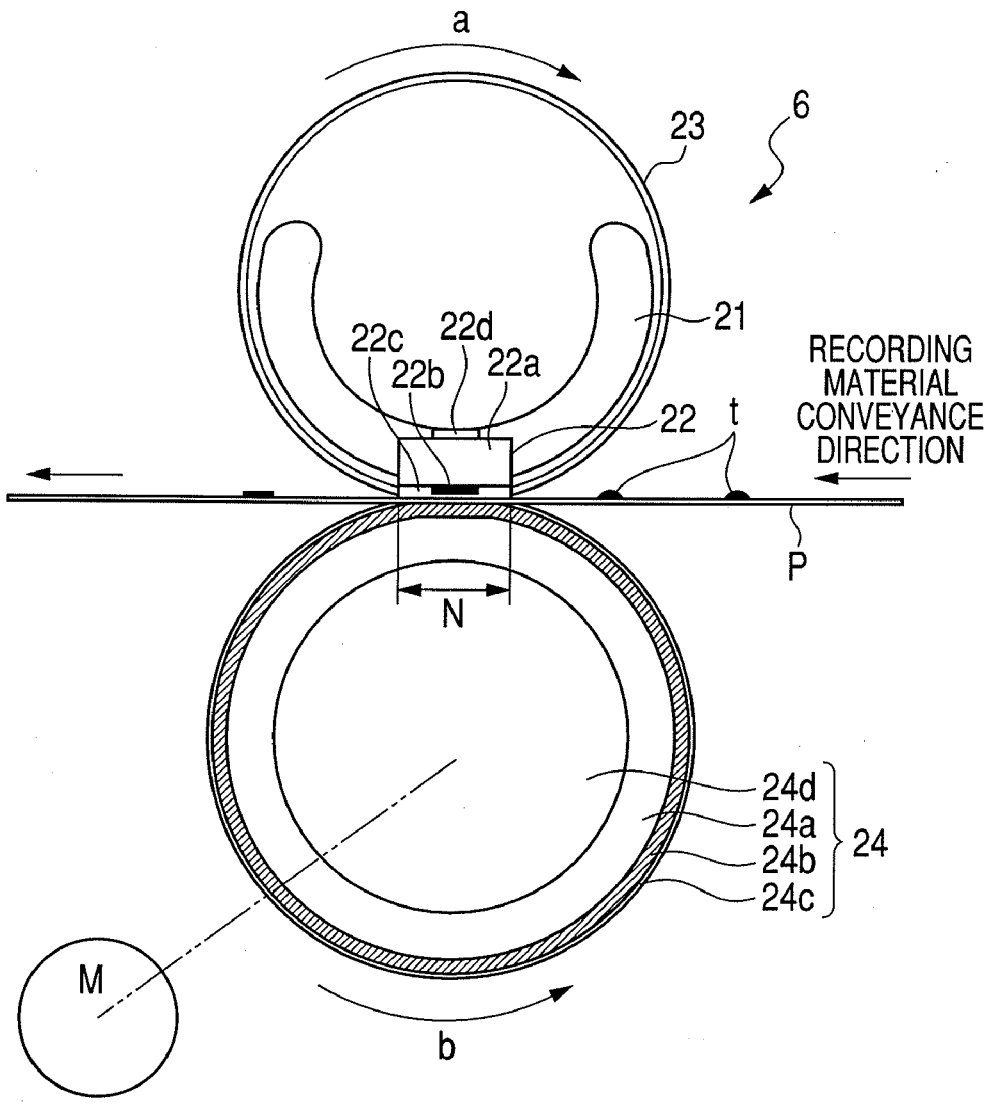
FIG. 2 is a schematic configuration diagram of a model of an image heating apparatus.

FIG. 2 is a schematic configuration diagram of a model of a fixing apparatus 6. The fixing apparatus 6 is a fixing apparatus of a film heating system.

A longitudinal film guide member (stay) 21 has in cross-section a substantially half-circular tub shape. The longitudinal direction of the film guide member 21 is perpendicular to the paper surface. A longitudinal heating body (heater) 22 is housed and held in a groove formed in a substantially center portion on the bottom surface of the film guide member 21 along the longitudinal direction. Reference numeral 23 denotes a flexible member. The flexible member 23 is an endless belt-like (cylindrical) heat-resistant film (flexible sleeve) loosely fitted to the film guide member 21 with the heating body 22. In the present embodiment, the heater 22 and the rotating cylindrical film 23 in contact with the heater 22 configures a heating member.

A longitudinal elastic pressure roller 24 is a pressure member pinching the film 23 and is brought into pressure-contact with the bottom surface of the heating body 22. A nip portion (fixing nip portion) N is formed between an elastic layer 24*a* of the pressure roller 24 brought into contact with the heating body 22 by pinching the film 23 and the heating body 22 by elastic deformation of a highly thermal conductive elastic rubber layer (an elastic layer containing filler) 24*b*. The pressure roller 24 is driven to rotate in a counterclockwise direction of an arrow b at a predetermined circumferential velocity with a drive force of the drive source M transferred through a drive transfer mechanism such as a gear not illustrated in the drawing.

The film guide member 21 is a molding product made of heat resistant resin selected from the group consisting of polyphenylene sulfite (PPS) and liquid polymer.

The heating body 22 is a ceramic heater generally with a low heat capacity. The heater 22 described in the present embodiment includes a longitudinal and thin plate-like heater substrate 22*a*, such as alumina, and a power dispatching heat-generating member (resistant heat-generating member) 22*b* comprising a wire like or a narrow belt like Ag/Pd formed along the longitudinal side of the surface (film sliding surface side). In addition, the heater 22 includes a thin surface protection layer 22*c*, such as a glass layer covering to protect the heat-generating member 22*b*. The rear surface side of the heater substrate 22*a* is provided with a temperature checking element 22*d*, such as a thermistor. The heater 22 is controlled to maintain a predetermined fixing temperature (target temperature) by a power controlling system (not illustrated in the drawing) including a temperature checking element 22*d* after a prompt temperature rise by power supply to the heat-generating member 22*b*.

The film 23 is a composite layer film having undergone coating of a mold-releasing layer (parting layer) on the surface of one of a single layer film and a base film with a total film thickness of not more than 100 μm, and suitably not more than 60 μm and not less than 20 μm, in order to reduce the heat capacity to improve quick starting performance of the apparatus. The material used for the single layer film is selected from the group consisting of PTFE (polytetrafluoroethylene), PFA (tetrafluoroethylene-perfluoroalkyl vinyl ether) and PPS with a property selected from the group consisting of a heat resistance, a mold releasing property, strength, and endurance. The material used for the base film is selected from the group consisting of polyimide polyamideimide, PEEK (polyether ketone), and PES (polyether sulfone). The material for the mold-releasing layer is selected from the group consisting of PTFE, PFA, and FEP (tetrafluoroethylene-perfluoroalkyl vinyl ether).

The pressure roller 24 includes elements selected from the group consisting of a core metal 24*d* made of material such as iron and aluminum, a solid rubber elastic layer 24*a* obtained from a material and manufacturing method detailed in the following third item, a highly thermal conductive elastic rubber layer 24*b*, and a mold-releasing layer 24*c*.

The pressure roller 24 is driven to rotate in a counterclockwise direction of an arrow b at least at the time of executing image forming. The motion of the film 23 is subordinate to the rotation of the pressure roller 24. In other words, when the pressure roller 24 is driven to rotate, friction force generated between the outer periphery surface (front surface) of the pressure roller 24 and the outer periphery surface (front surface) of the film 23 generates a rotation force that acts on the film 23 in the nip portion N. At the time when the film 23 rotates, the inner periphery surface (inner surface) of the film 23 contacts the surface protection layer 22*c* of the heater 22 to slide in the nip portion N. In the above described case, a lubricant, such as heat resistant grease, can be placed between the inner surface of the film 23 and the surface protection layer 22*c* of the heater 22 in order to reduce slide resistance between the both parts.

The recording material is pinched and conveyed with the nip portion N so that the toner image on the recording material undergoes heat fixing. The recording material P coming out of the nip portion N is separated and conveyed from the surface of the film 23 and is discharged from the fixing apparatus 6.

Since a heating body (ceramic heater) 22 with a small heat capacity and fast temperature rise is used for the fixing apparatus 6 of a film heating system as in the present embodiment, the heater 22 can significantly reduce the time until the heater 22 reaches a predetermined fixing temperature. Consequently, the normal temperature can easily rise to reach a high fixing temperature. Accordingly, stand-by temperature adjustment is not required when the fixing apparatus 6 is in the stand-by state at the time of non-printing, but can allow power saving.

In addition, substantially no tension acts on the rotating film 23 beside the nip portion N. Only a flange member (not illustrated in the drawing) and only enough of the flange member to receive the tip of the film 23 as a unit restraining movement toward the film 23 is arranged in the apparatus.

(3) Pressure Roller 24

The above described pressure roller 24 will be described in detail as follows on the point of material configuring the pressure roller and a molding method.

3-1) Layer Configuration of Pressure Roller 24

Figure 3:
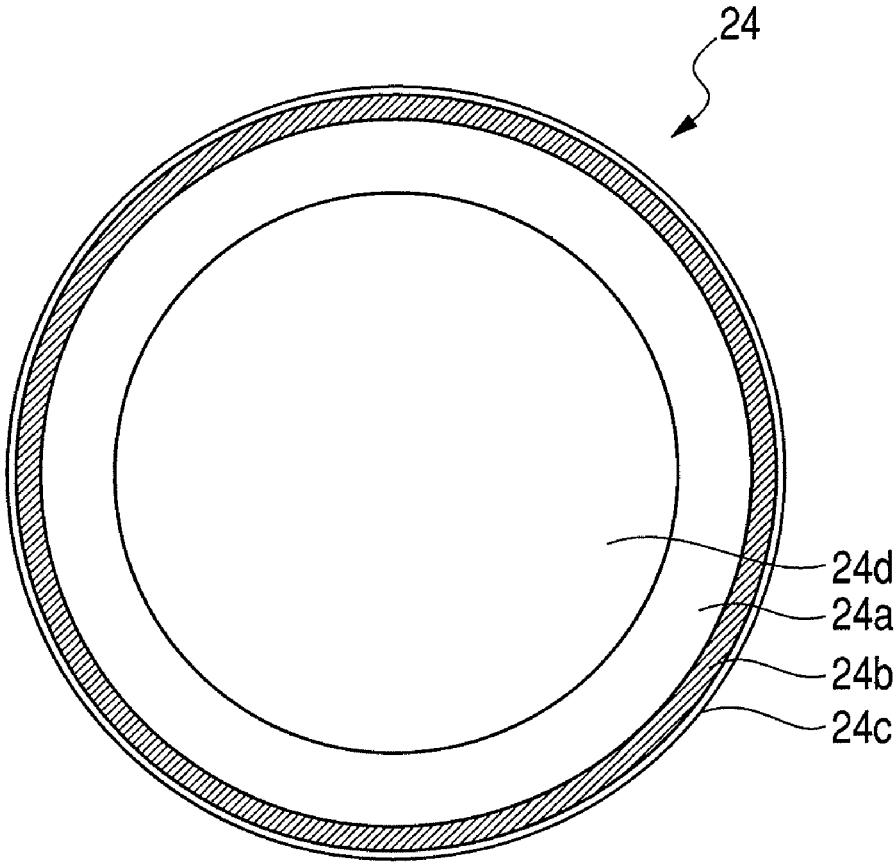
FIG. 3 is a schematic configuration diagram of a layer of a pressure roller.

FIG. 3 is a schematic configuration diagram of a model of a pressure roller 24.

The layer configuration of the pressure roller 24 described in the present embodiment includes, at least, a solid rubber elastic layer (heat resistant rubber layer) 24*a* as a first elastic layer and an elastic layer 24*b* as a second elastic layer having thermal conductive property whose value is higher than that of the solid rubber elastic layer 24*a* by containing filler on the outer periphery of the round shaft core metal 24*d*. The elastic layer 24*b* will be described as a highly thermal conductive elastic rubber layer. In addition, a mold-releasing layer 24*c* is included in the outer periphery of the highly thermal conductive elastic rubber layer 24*b*. In other words, the layer configuration of the pressure roller 24 is a configuration obtained by stacking a solid rubber elastic layer (heat resistant rubber layer) 24*a*, a highly thermal conductive elastic rubber layer 24*b* (elastic layer containing filler) and a mold-releasing layer 24*c* and in the order of the a solid rubber elastic layer 24*a*, the highly thermal conductive elastic rubber layer 24*b* and the mold-releasing layer 24*c* on the outer periphery of the round shaft core metal 24*d*. In other words, the pressure roller includes a solid rubber elastic layer formed on the outer periphery of the core metal. The elastic layer containing filler is formed on the outer periphery of the solid rubber elastic layer.

The solid rubber elastic layer 24*a* is made of flexible and heat resistant material represented by silicone rubber. In addition, as described above, the solid rubber elastic layer 24*a* has a lower thermal conductivity than the elastic layer 24*b* containing filler.

The highly thermal conductive elastic rubber layer 24*b* is formed on the outer periphery of the solid rubber elastic layer 24*a*. In other words, the highly conductive elastic layer is provided closer to the front layer side of the pressure member than to the solid rubber elastic layer 24*a*. The highly thermal conductive elastic rubber layer 24*b* is made of rubber, which is made of flexible and heat resistant material represented by silicone rubber, containing thermal conductive filler.

The mold-releasing layer 24*c* is formed on the outer periphery of the highly thermal conductive elastic rubber layer 24*b*. In other words, the pressure member includes a mold-releasing layer in the outermost layer (uppermost surface layer) on the of the pressure member. The mold-releasing layer 24*c* is made of material suitable for the pressure roller surface represented by one of fluorine resin and fluorine rubber.

3-1-1) Solid Rubber Elastic Layer 24*a*

The thickness of the entire elastic layer obtained by adding thickness of the solid rubber elastic layer 24*a* and the highly thermal conductive elastic rubber layer 24*b* used for the pressure roller 24 is not limited in particular but should be 2 to 10 mm in thickness and capable of forming the nip portion N with a desired width. The thickness of the solid rubber elastic layer 24*a* within the above described range will not be limited in particular but can be adjusted to attain the required thickness appropriately corresponding to the hardness of the highly thermal conductive elastic rubber layer 24*b* to be described in detail in the following item.

The general heat resistant solid rubber elastic material selected from the group consisting of one of silicone rubber and fluorine rubber can be used for the solid rubber elastic layer 24*a*. Any of these materials provides sufficient heat resistance and endurance and suitable elasticity (softness) in the case of use of the fixing apparatus 6. Accordingly, any of the silicone rubber and the fluorine rubber is suitable as main material for the solid rubber elastic layer 24*a*.

The silicone rubber can be exemplified by addition reactive dimethyl silicone rubber as a representative example obtained by forming rubber bridging with dimethylpolysiloxane, for example, to undergo an addition reaction with a vinyl group and silicon combined hydrogen group. As fluorocarbon rubber, a two-dimensional radial reactive type fluorocarbon rubber including a base polymer made of binary copolymer of vinylidene fluoride and hexafluoropyrene obtained by forming a rubber bridge by a radical reaction with peroxide can be exemplified as a representative example. Otherwise, three-dimensional radial reactive type fluorocarbon rubber including a base polymer made of ternary copolymer of vinylidene fluoride, hexafluoropyrene and tetrafluoroethylene obtained by forming a rubber bridge by radical reaction with peroxide can be exemplified as a representative example.

However, in the pressure roller 24, since a configuration obtained by applying a so-called foamed sponge rubber, for example, instead of the solid rubber elastic layer 24*a* is effective in terms of heat insulation but is inferior in terms of endurance performance, it is important to use solid rubber as the material for the elastic layer 24*a*.

The solid rubber elastic layer 24*a* referred to here, refers to one of a layer made of only a rubber polymer which is not a foamed sponge rubber layer such as foamed sponge rubber and a layer made of only rubber poly, which is not foamed sponge rubber, and inorganic filler.

The thermal conductivity $\lambda$ in the thickness direction (radial direction of the pressure roller) of the solid rubber elastic layer 24*a*, being non-foamed rubber layer, used in the present invention is not less than 0.16 W (m·k) but not more than 0.40 W/(m·k). The thermal conductivity was measured with Quick Thermal Conductivity Meter QTM-500, a product manufactured by KYOTO ELECTRONICS MANUFACTURING Co., LTD.

A method of forming the solid rubber elastic layer 24*a* is not limited in particular. However general form molding can be suitably adopted.

3-1-2) Highly Thermal Conductive Elastic Rubber Layer 24*b*

A highly thermal conductive elastic rubber layer 24*b* is formed to provide a uniform thickness on the solid rubber elastic layer 24*a*. If the thickness of the highly thermal conductive elastic rubber layer 24*b* falls within the range described in the above described section 3-1-1), an arbitrary thickness useful as the pressure roller 24 can be used. The highly thermal conductive elastic rubber layer 24*b* is essentially formed by carbon fiber 24*f* as a thermal conductive filler being dispersed in heat resistant elastic material 24*e* (see FIGS. 6A and 6B).

A heat resistant rubber material selected from the group consisting of silicone rubber and fluorocarbon rubber can be used as the heat resistant elastic material 24*e* and likewise can be used in the case of the solid rubber elastic layer 24*a*. In the case of using silicone rubber as the heat resistant elastic material 24*e*, addition silicone rubber is popular in view of likeliness in availability and easy processing.

Prior to hardening the source rubber, dripping occurs at the time of processing if the viscosity is too low. If the viscosity is too high, combination and dispersion will be difficult. Consequently, source rubber in a range of 0.1 to 1000 Pa·s is desirable.

The carbon fiber 24*f* acts as a filler for securing the thermal conductivity of the highly thermal conductive elastic rubber layer 24*b*. A thermal flow path can be formed by dispersion of the carbon fiber 24*f* in the heat resistant elastic material 24*e*. In addition, the carbon fiber 24*f*, which is like thin and longitudinal fiber (spicla), is kneaded with the heat resistant elastic material 24*e* in a liquid state prior to hardening and likely to be orientated in the direction of stream, in other words, in the longitudinal direction of the solid rubber elastic layer 24*a*. Consequently, the thermal conductivity in the longitudinal direction of the highly thermal conductive elastic rubber layer 24*b* can be intensified. Accordingly, the thermal flow in the longitudinal direction perpendicular to the recording material conveyance direction (see FIG. 2) will get larger than the thermal flow in the other direction so that efficient thermal dispersion from the high temperature side, such as non-sheet feeding portion of the heater 22 to the sheet feeding portion, will be obtained.

Next, the appearance of the carbon fiber 24*f* being orientated in the highly thermal conductive elastic rubber layer 24*b* will be described in detail.

Figure 4A:
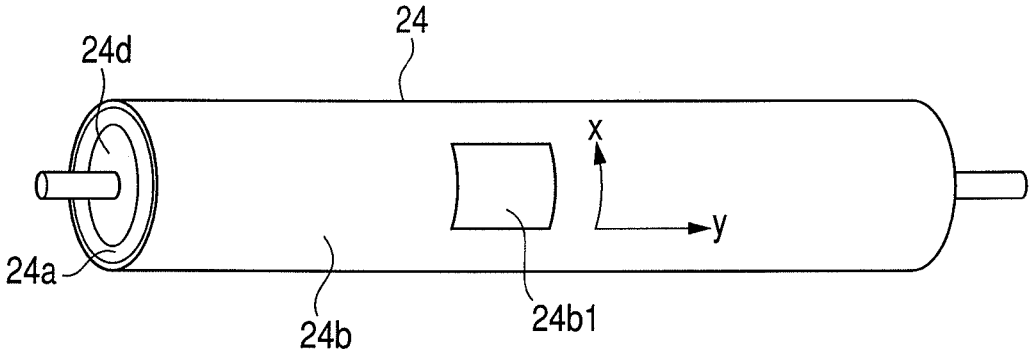
FIGS. 4A and 4B are diagrams illustrating a roller formed in the procedure of manufacturing a pressure roller.
Figure 4B:
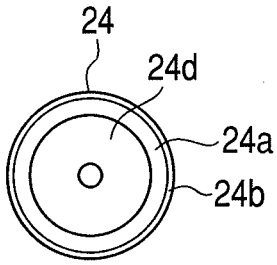
Figure 5:
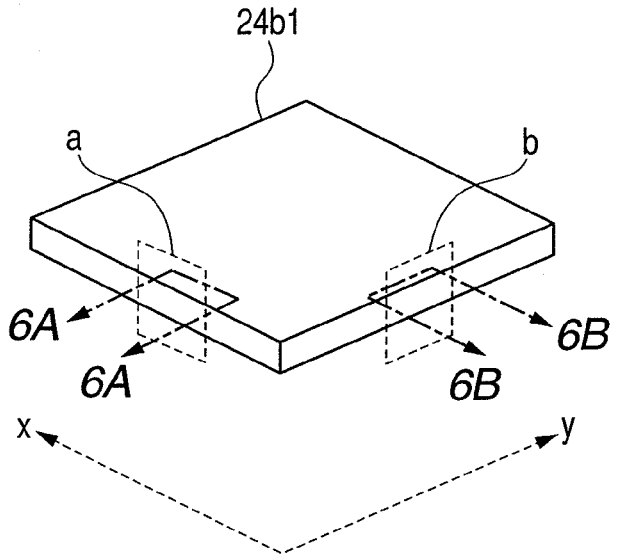
FIG. 5 is an enlarged perspective diagram of a cutout sample of a highly thermal conductive elastic rubber layer of the roller illustrated in FIG. 4.
Figure 6A:
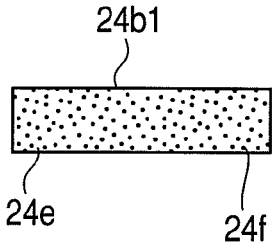
FIG. 6A is an enlarged sectional diagram of a cutout sample taken along line 6A-6A in FIG. 5.
Figure 6B:
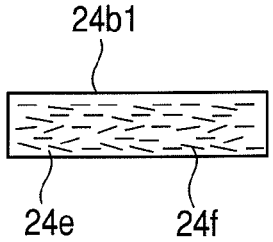
FIG. 6B is an enlarged sectional diagram of a cutout sample taken along line 6B-6B in FIG. 5.
Figure 7:
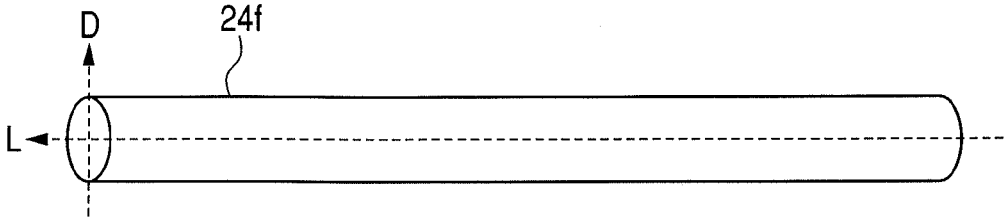
FIG. 7 is an explanatory diagram exemplifying carbon fiber.

FIG. 4A and FIG. 4B are explanatory diagrams of a roller being formed during a procedure of manufacturing a pressure roller 24. FIG. 4A is a complete perspective view of a roller made of a highly thermal conductive elastic rubber layer 24*b* being molded on the outer periphery of the solid rubber elastic layer 24*a* on the core metal 24*a*. FIG. 4B is a right side view of the roller illustrated in FIG. 4A. FIG. 5 is an enlarged perspective diagram of a cutout sample 24*b*1 of a highly thermal conductive elastic rubber layer 24*b* of the roller illustrated in FIG. 4A. FIG. 6A is an enlarged sectional diagram of the cutout sample 24*b*1 taken along line 6A-6A in FIG. 5. FIG. 6B is an enlarged sectional diagram of the cutout sample 24*b*1 taken along line 6B-6B in FIG. 5. FIG. 7 is an explanatory diagram exemplifying carbon fiber 24*f* and is an explanatory diagram illustrating a fiber diameter portion D and a fiber length portion L of the carbon fiber 24*f*.

As illustrated in FIG. 4A, in a roller with a highly thermal conductive elastic rubber layer 24*b* being formed on the outer periphery of a solid rubber elastic layer 24*a* on core metal 24*d*, the highly thermal conductive elastic rubber layer 24*b* is cut so that a cut portion is taken out in the x direction (periphery direction) and in the y direction (longitudinal direction). An a-section in the x direction and a b-section in the y direction of the cut out sample 24*b*1 of the highly thermal conductive elastic rubber layer 24*b* are respectively observed as in FIG. 5. As a result, as for the a-section in the x direction, the fiber diameter portion D (see FIG. 7) of the carbon fiber 24*f* as in FIG. 6A is mainly observed. As for the b-section in the y direction, the fiber length portion L (see FIG. 7) of the carbon fiber 24*f* is frequently observed as in FIG. 6B.

In the carbon fiber 24*f*, if an average value of the fiber length portion L is shorter than 10 μm, a thermal conductivity anisotropic effect hardly appears in the highly thermal conductive elastic rubber layer 24*b*. In other words, if the thermal conductivity is high in the longitudinal direction of the highly thermal conductive elastic rubber layer 24*b* and the thermal conductivity is low in the periphery direction, energy saving can be planned also in obtaining the same fixing performance, since the amount of heat at the non-sheet feeding portion can be supplied in the center portion in the nip. If the average value of the fiber length portion L is longer than 1 mm, dispersed process molding of the carbon fiber 24*f* into the highly thermal conductive elastic rubber layer 24*b* is difficult. Consequently, the length of the carbon fiber 24*f* is not less than 0.01 mm and not more than 1 mm, and suitably not less than 0.05 mm and not more than 1 mm.

As the above described carbon fiber 24*f*, pitch based carbon fiber manufactured by adopting oil pitch and coal pitch as raw materials is suitable due to the thermal conductive performance of the above described carbon fiber 24*f*.

In addition, the lower limit of the dispersed content amount in the heat resistant elastic material 24*e* of the carbon fiber 24*f* is 5 vol %. If the lower limit is under 5 vol %, the thermal conductance deteriorates so that no desired thermal conductive value is obtainable. The upper limit of the dispersed content amount in the heat resistant elastic material 24*e* of the carbon fiber 24*f* is 40 vol %. If the upper limit is over 40 vol %, the processing shape is difficult and concurrently hardness will increase so that no desired hardness value is obtainable. In short, in the highly thermal conductive elastic rubber layer 24*b*, thermal conductive filler is dispersed at percentage of not less than 5 vol % and not more than 40 vol %. Suitably, in the highly thermal conductive elastic rubber layer 24*b*, the thermal conductive filler is dispersed at percentage of not less than 15 vol % and not more than 40 vol %.

In addition, the thermal conductivity $\lambda_f$ in the direction of length (fiber axis direction) of the carbon fiber 24*f* is suitably not less than 500 W/(m·k) ($\lambda_f \geqq 500$ W/(m·k)). Measurement of the thermal conductivity $\lambda_f$ was performed by the laser flash method with a Laser Flash Method Thermal Constant Measuring System TC-7000 manufactured by ULVAC-RIK0, Inc.

The molding method of the highly thermal conductive elastic rubber layer 24*b* will not be limited in particular but, in general, a molding method selected from the group consisting of the form molding and coat molding can be used. In addition, a ring coat method disclosed in a patent document of Japanese Patent Application Laid-Open No. 2003-190870 and Japanese Patent Application Laid-Open No. 2004-290853 is adoptable. The highly thermal conductive elastic rubber layer 24*b* can be formed in a seamless shape on the outer periphery of the solid rubber elastic layer 24*a* by the above described various method.

The thickness of the highly thermal conductive elastic rubber layer 24*b* of 0.10 to 5 mm is suitable for molding in terms of performance and can be appropriately adjusted with the thickness of the solid rubber elastic layer 24*a* in the lower layer. In the above described case, in the case where the thickness proportion of the highly thermal conductive elastic rubber layer 24*b* in the upper layer to the solid rubber elastic layer 24*a* in the lower layer is defined by (thickness of the highly thermal conductive elastic rubber layer 24*b*)/(thickness of solid rubber elastic layer 24*a*), a range of 0.02 to 2 is suitable.

The hardness of the highly thermal conductive elastic rubber layer 24*b* suitably falls within a range of predetermined hardness in view of securing the desired nip width.

In the present embodiment, the hardness of the highly thermal conductive elastic rubber layer 24*b* falls within a range of 5 to 60 degrees for a hardness (to be referred to as the ASKER-C hardness below) measured with the ASKER Durometer Type C manufactured by KOBUNSHI KEIKI CO., LTD. which satisfies the JIS K7312 and SRIS 0101 standards. If the ASKER-C hardness of the highly thermal conductive elastic rubber layer 24*b* falls within the above described range, the desired nip width can be sufficiently secured. A test sample allowing no sufficient thickness to be secured in order to measure the ASKER-C hardness undergoes measurement by cutting out only the highly thermal conductive elastic rubber layer 24*b* to stack the required number of sheets appropriately. The ASKER-C hardness of the stacked test sample to be measured is measured. For the present embodiment, the test sample to be measured was measured when subjected to a securing thickness of 15 mm.

In addition, the thermal conductivity of the highly thermal conductive elastic rubber layer 24*b* in the recording material conveyance direction (the periphery direction of the roller hereinafter to be referred to as the x direction) and the direction perpendicular to the above described x direction (the longitudinal direction of the roller hereinafter to be referred as the y direction) can be measured by the hot disk method. TPA-501 manufactured by KYOTO ELECTRONICS MANUFACTURING CO., LTD. was used as the above described measurement apparatus. In order to secure a thickness sufficient for measurement, as illustrated in FIG. 4A and FIG. 5, only a highly thermal conductive elastic rubber layer 24*b* is cut out to form the test sample to be measured by stacking a predetermined number of sheets and the thermal conductivity in the x direction and the y direction of the test sample to be measured are respectively measured.

Figure 8A:
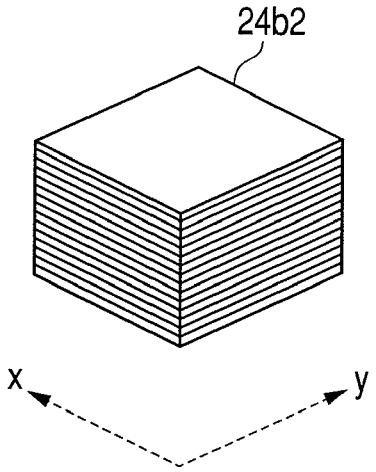
FIGS. 8A, 8B and 8C are explanatory views illustrating a method of measuring thermal conductivity of a highly thermal conductive elastic rubber layer.
Figure 8B:
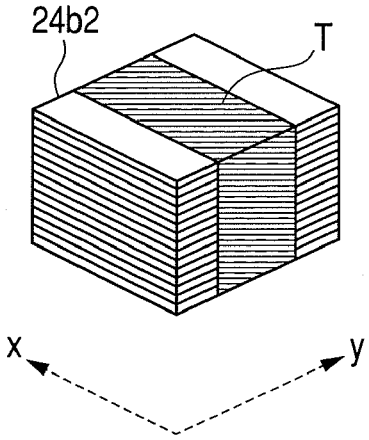
Figure 8C:
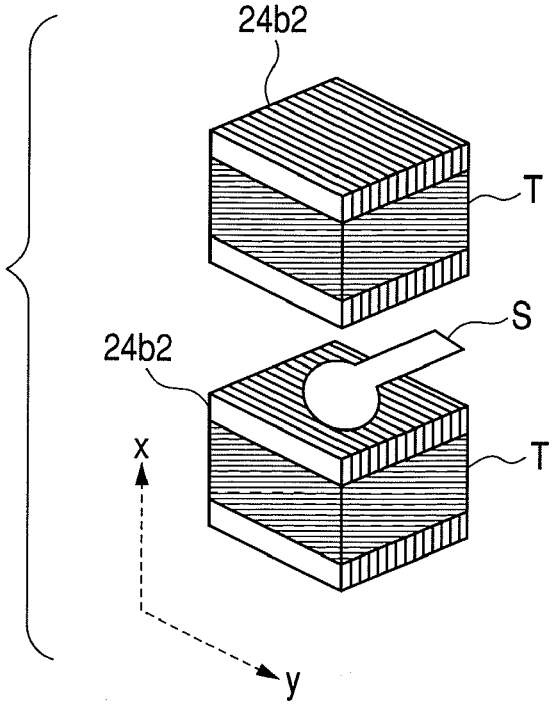

FIGS. 8A-8C are an explanatory views illustrating a method of measuring the thermal conductivity of a highly thermal conductive elastic rubber layer 24*b*.

For the present embodiment, the highly thermal conductive elastic rubber layer 24*b* is cut out and the cut-out portion has the dimensions of 15 mm (in x direction)×15 mm (in y direction)×thickness (set thickness) and is stacked to provide a thickness of approximately 15 mm to attain a test sample to be measured 24*b*2 (see FIG. 8A). Next, a kapton tape T with width of 10 mm for fixation is applied so that the above described test sample to be measured 24*b*2 can be fixed (see FIG. 8B). Next, in order to equalize the level of flatness of the surface to be measured of the test sample to be measured 24*b*2, the surface to be measured and the rear surface of the surface to be measured are cut with a laser. Two sets of the above described test sample to be measured 24*b*2 are prepared. A sensor S is pinched by the two test samples to be measured to measure the thermal conductivity (see FIG. 8C). In the case where the test sample to be measured 24*b*2 is measured and subjected to a change in the direction (x direction and y direction), the measurement direction is changed to carry out the method as described above. For the present embodiment, an average value of the five times of measurement was used.

For the highly thermal conductive elastic rubber layer 24*b* in the pressure roller 24 in the present embodiment, the thermal conductivity $\lambda_y$ essentially in the y direction (longitudinal direction) falls within an range of not less than 2.5 W/(m·k) ($\lambda_y \geqq 2.5$ W/(m·k)) at the time of measurement by the above described measurement method. Further suitably, the thermal conductivity $\lambda_y$ in the y direction (longitudinal direction) falls within the range of not less than 10 W/(m·k) ($\lambda_y \geqq 10$ W/(m·k)).

Since the thermal conductivity $\lambda_y$ in the y direction of the highly thermal conductive elastic rubber layer 24*b* is not less than 2.5 W/(m·k), the temperature rise in the region where no recording material P passes (non-sheet feeding region) can be suppressed sufficiently also at the time of rapid printing. Moreover, since the $\lambda_y$ is not less than 10 W/(m·k), the temperature rise in the region where no recording material P passes can be suppressed further.

3-1-3) Mold-Releasing Layer 24*d*

A mold-releasing layer 24*c* can be formed by covering a PFA tube on the highly thermal conductive elastic rubber layer 24*b* and can be formed by coating the elastic layer with one of fluorocarbon rubber and fluorine resin selected from the group consisting of PTFE, PFA and FEP. The thickness of the mold-releasing layer 24*c* will not be limited in particular if the above described thickness can give sufficient mold-releasing performance to the pressure roller 24 but is suitably 20 to 100 μm.

Moreover, between the solid rubber elastic layer 24*a* and the highly thermal conductive elastic rubber layer 24*b* and between the highly thermal conductive elastic rubber layer 24*b* and the mold-releasing layer 24*d*, a primer layer and an adhesive layer can be formed for the purpose of adhesion and conduction. In addition, the respective layers can be in the multi-layer configuration within the range of the present invention. In addition, in the pressure roller 24, a layer besides the above described layer can be formed for the purpose of providing a sliding property, a heat-generating property and a mold-releasing property. The order of forming the above described layers will not be limited in particular, but can be replaced appropriately due to convenience for the respective steps.

(4) Performance Assessment on Pressure Roller 24

On a pressure roller 24, the following various kinds of embodiment rollers 1 to 18 and comparative rollers 19 to 21 were produced to assess the performance of the respective rollers.

At first, carbon fibers used for the embodiment rollers 1 to 18 and comparative rollers 19 to 21 will be described.

- 100-05M: pitch based carbon fiber, commodity name: XN-100-05M, manufactured by Nippon Graphite Fiber Corporation, average fiber diameter: 9 μm, average fiber length L: 50 μm, thermal conductivity of 900 W/(m·k).
- 100-15M: pitch based carbon fiber, commodity name: XN-100-15M, manufactured by Nippon Graphite Fiber Corporation, average fiber diameter: 9 μm, average fiber length L: 150 μm, thermal conductivity of 900 W/(m·k).
- 100-25M: pitch based carbon fiber, commodity name: XN-100-25M, manufactured by Nippon Graphite Fiber Corporation, average fiber diameter: 9 μm, average fiber length L: 250 μm, thermal conductivity of 900 W/(m·k).
- 100-50M: pitch based carbon fiber, commodity name: XN-100-50M, manufactured by Nippon Graphite Fiber Corporation, average fiber diameter: 9 μm, average fiber length L: 500 μm, thermal conductivity of 900 W/(m·k).
- 100-01: pitch based carbon fiber, commodity name: XN-100-01, manufactured by Nippon Graphite Fiber Corporation, average fiber diameter: 10 μm, average fiber length L: 1 mm, thermal conductivity of 900 W/(m·k).
- 90C-15M: pitch based carbon fiber, commodity name: XN-90C-15M, manufactured by Nippon Graphite Fiber Corporation, average fiber diameter: 10 μm, average fiber length L: 150 μm, thermal conductivity of 500 W/(m·k).

80C-15M: pitch based carbon fiber, commodity name: XN-80C-15M, manufactured by Nippon Graphite Fiber Corporation, average fiber diameter: 10 μm, average fiber length L: 150 μm, thermal conductivity of 320 W/(m·k).

60C-15M: pitch based carbon fiber, commodity name: XN-60C-15M, manufactured by Nippon Graphite Fiber Corporation, average fiber diameter: 10 μm, average fiber length L: 150 μm, thermal conductivity of 180 W/(m·k).

4-1) Embodiment Roller 1

At first, on the outer periphery of core metal 24*d* made of Al with ϕ22, an elastic layer formation 1 with ϕ28 in which a solid rubber elastic layer 24*a* with thickness of 3 mm is formed by form molding method with silicone rubber of an addition reactive hardening type with density being 1.20 g/cm$^3$ was obtained. Heating and hardening were carried out at 150° C.×30 minutes as a temperature condition.

Next, the molding method of a highly thermal conductive elastic rubber layer 24*b* will be described.

At first, an addition hardening type silicone rubber source liquid was composed of both A liquid and B liquid, wherein weight-average molecular weight Mw=65000, number average molecular weight Mn=15000, Liquid A • • • vinyl based concentration (0.863 mol %), SiH concentration (none,) viscosity (7.8 Pa·s), Liquid B • • • vinyl based concentration (0.955 mol %), SiH concentration (0.780 mol %), and viscosity (6.2 Pa·s), where H/Vi=0.43 under A/B=1/1 at a proportion of 1:1, and a platinum compound as catalyser is added to obtain addition hardening type silicone rubber source liquid.

For the above described addition hardening type silicone rubber source liquid, pitch based carbon fiber 100-05M is uniformly composed and mixed and at a volumetric percentage of 15% to obtain a silicone rubber composition 1.

Next, the elastic layer formation 1 with ϕ28 was set to a metal mold with an inner diameter of ϕ30 so as to equalize the core shafts. The silicone rubber composition 1 was injected between the metal mold and the elastic layer formation 1 to obtain an elastic layer formation 2 provided with the highly thermal conductive elastic rubber layer 24*b* with an outer diameter ϕ30 through heating and hardening under the condition of 150° C.×60 minutes. Moreover, on the outer surface of the above described elastic layer formation 2, a PFA (tetrafluoroethylene-perfluoroalkyl vinyl ether copolymer) tube (thickness of 50 μm) was coated and the both end portions were split to obtain a pressure roller with length 320 mm in the longitudinal direction. The pressure roller was taken as the embodiment roller 1.

A highly thermal conductive elastic rubber layer 24*b* was formed separately on the outer periphery of the elastic layer formation 1 as described above. The ASKER-C hardness measured under the condition where 15 sheets with a cutout thickness of the above described highly thermal conductive elastic rubber layer 24*b* to reach 15 mm was 17 degrees. The highly thermal conductive elastic rubber layer 24*b* was cut out and the thermal conductivity in the y direction (longitudinal direction) measured by the above described method was 2.55 W/(m·k). A table 1 is filled with a result of the above described measurement.

4-2) Embodiment Rollers 2 to 18

The carbon fiber specified in the table 1 was used at a filling amount indicated in the table 1.

For an embodiment roller 4, a pressure roller was produced like the embodiment roller 1, being adjusted to attain an A/B proportion specified in the embodiment roller 1 of A/B=0.5. The pressure roller is taken as the embodiment roller 4.

In addition, for embodiment rollers 5, 8, 11 and 14, the addition hardening type silicone rubber source liquid to be described below was used.

This addition hardening type silicone rubber source liquid has a weight-average molecular weight Mw=33000, a number average molecular weight Mn=16000, a Liquid A • • • vinyl based concentration (0.820 mol %), SiH concentration (none), a viscosity (1.1 Pa·s), a Liquid B • • • vinyl based concentration (0.827 mol %), SiH concentration (0.741 mol %), and a viscosity (1.1 Pa·s), where H/Vi=0.45 under A/B=1/1

Otherwise, like the embodiment roller 1, the embodiment rollers 5, 8, 11 and 14 were produced. The other embodiment rollers 2, 3, 6, 7, 9, 10, 12, 13 and 15 to 18 were measured at the filling amount specified in the table 1 but otherwise are like the embodiment roller 1, so as to obtain embodiment rollers 2, 3, 6, 7, 9, 10, 12, 13 and 15 to 18. The thermal conductivity in the x direction and the y direction of the highly thermal conductive elastic rubber layer 24*b* and the ASKER-C hardness were measured. The result of the above described measurement is indicated in the table 1.

4-3) Comparative Roller 19

A comparative roller 19 was made of the solid rubber elastic layer 24*a* configured by silicone rubber with an ASKER-C hardness of 32 degrees, a thermal conductivity of 0.4 W/(m·k) and thickness of 4 mm. The thermal conductivity of the silicone rubber used for the comparative roller 19 was set to be not more than 0.2 W/(m·k) by adding a slightly larger amount of thermal conductive filler. Silica was used for the thermal conductive filler, which is also used as reinforcing agent. Without providing the highly thermal conductive elastic rubber layer 24*b*, the comparative roller 19 is entirely configured by only solid rubber elastic layer and otherwise is configured like the embodiment roller 1.

4-4) Comparative Roller 20

A comparative roller 20 was configured like the embodiment roller 1 except that foamed sponge rubber with an ASKER-C hardness of 29 degrees and a thermal conductivity of 0.11 W/(m·k) was adopted instead of the solid rubber elastic layer 24*a*. The average cell diameter of the above described foamed sponge was 50 μm.

4-5) Comparative Roller 21

For a comparative roller 21, an elastic layer formed on the outer periphery of core metal was configured only by a highly thermal conductive elastic rubber layer 24*b* with the carbon fiber specified in the embodiment roller 6 with a thickness of 4 mm. In short, the comparative roller 21 was configured to include no solid rubber elastic layer. Otherwise, the configuration is the same as the configuration of the embodiment roller 1.

TABLE 1

| | PRESSURE MEMBER No. | CARBON FIBER TYPE | CARBON FIBER AVERAGE FIBER LENGTH | CARBON FIBER RATE OF CONTENT (VOL %) | THERMAL CONDUCTIVITY W/(m · k) | RUBBER WITH DISPERSED CARBON FIBER THERMAL CONDUCTIVITY W/(m · k) (y DIRECTION) | (x DIRECTION) | y/x | HARDNESS (ASKER-C) | FILM SURFACE TEMPERATURE AT NON-SHEET FEEDING PORTION | ENDURANCE (HARDNESS) | CONVEYABILITY |
|---|---|---|---|---|---|---|---|---|---|---|---|---|
| EMBODIMENT ROLLER | 1 | XN-100 | 50 μm | 15% | 900 | 2.5 | 1.08 | 2.31 | 17° | 290.5 ○ | ◎ | ○ |
| | 2 | XN-100 | 50 μm | 25% | 900 | 10.67 | 4.83 | 2.21 | 27° | 272.5 ◎ | ◎ | ○ |
| | 3 | XN-100 | 50 μm | 35% | 900 | 39.22 | 18.33 | 2.14 | 39° | 256.2 ◎ | ◎ | ○ |
| | 4 | XN-100 | 50 μm | 35% | 900 | 38.15 | 19.08 | 2.00 | 60° | 257.1 ◎ | ◎ | ○ |
| | 5 | XN-100 | 50 μm | 40% | 900 | 85.67 | 36.30 | 2.36 | 47° | 247.7 ◎ | ○ | ○ |
| | 6 | XN-100 | 150 μm | 15% | 900 | 7.66 | 3.17 | 2.42 | 20° | 276.8 ◎ | ◎ | ○ |
| | 7 | XN-100 | 150 μm | 30% | 900 | 65.78 | 29.90 | 2.20 | 35° | 250.6 ◎ | ◎ | ○ |
| | 8 | XN-100 | 150 μm | 35% | 900 | 117.2 | 50.96 | 2.30 | 42° | 244.2 ◎ | ○ | ○ |
| | 9 | XN-100 | 250 μm | 15% | 900 | 9.96 | 4.08 | 2.44 | 24° | 273.3 ◎ | ◎ | ○ |
| | 10 | XN-100 | 250 μm | 25% | 900 | 41.6 | 16.98 | 2.45 | 34° | 256.0 ◎ | ◎ | ○ |
| | 11 | XN-100 | 250 μm | 30% | 900 | 80.23 | 32.09 | 2.50 | 39° | 248.2 ◎ | ○ | ○ |
| | 12 | XN-100 | 500 μm | 5% | 900 | 3.56 | 1.42 | 2.50 | 29° | 286.8 ○ | ◎ | ○ |
| | 13 | XN-100 | 500 μm | 15% | 900 | 21.44 | 8.72 | 2.46 | 34° | 263.9 ◎ | ◎ | ○ |
| | 14 | XN-100 | 500 μm | 25% | 900 | 89.6 | 35.70 | 2.51 | 44° | 247.2 ◎ | ○ | ○ |
| | 15 | XN-100 | 1 mm | 5% | 900 | 6.35 | 2.27 | 2.80 | 49° | 278.9 ◎ | ◎ | ○ |
| | 16 | XN-100 | 1 mm | 15% | 900 | 38.3 | 13.73 | 2.79 | 55° | 257.0 ◎ | ◎ | ○ |
| | 17 | XN-90C | 150 μm | 15% | 500 | 4.26 | 1.94 | 2.20 | 20° | 284.4 ○ | ◎ | ○ |
| | 18 | XN-90C | 150 μm | 30% | 500 | 37.89 | 16.40 | 2.31 | 35° | 257.1 ◎ | ◎ | ○ |
| COMP. ROLLER | 23 | — | — | — | — | — | — | | 32° | 311.2 X | X | ○ |
| | 24 | XN-100 | 50 μm | 15% | 900 | 2.48 | 1.01 | 2.46 | 17° | 295.6 ○ | X | ○ |
| | 25 | XN-100 | 150 μm | 15% | 900 | 6.52 | 4.23 | 1.54 | 20° | 273.2 ◎ | ◎ | X |

Performance Assessment

<Temperature Rising at Non-Sheet Feeding Portion>

For the performance assessment, with a pressure roller produced with the above described technique in the fixing apparatus (FIG. 2), the one in which the pressure roller was incorporated in a laser printer printing at a printing speed of 50 sheets/minute (for the longitudinal side of A4 sized sheet), corresponding to the A3 sized sheet as describe above, was used.

In the above described printer, the surface moving speed (circumferential velocity) of the pressure roller was adjusted to attain 234 mm/sec. The temperature adjustment on the fixing temperature was set to 220° C. The temperature of the above described case at the non-sheet feeding region (non-sheet feeding portion) was measured. The sheet having undergone sheet feeding at the nip portion is a sheet with an LTR longitudinal-sized sheet (75 g/m$^2$). The film surface temperature at a non-sheet feeding portion was measured at the time when 500 sheets have undergone sheet feeding continuously at 50 sheets per minute.

In the table 1, the entries with the temperature at a non-sheet feeding portion of less than 280° C. are marked by ◎. The entries with the temperature at a non-sheet feeding portion of not less than 280° C. and less than 300° C. are marked by ○. The entries with the temperature at non-sheet feeding portion of not less than 300° C. are marked by X. In the present invention, in the case where the temperature at the non-sheet feeding portion is not less than 300° C., the roller is determined to be in the state where the temperature at the non-sheet feeding portion has excessively risen.

<Endurance (Hardness Decrease in Rubber Layer Being Factor)>

When a temperature rise at non-sheet feeding portion occurs, the hardness of a region where a temperature rise at the non-sheet feeding portion occurs tends to drop. In addition, when 150,000 sheets have undergone sheet feeding while the temperature rise at the non-sheet feeding portion continues to occur, the temperature at the non-sheet feeding portion will excessively rise so that it is possible for one of destruction of the rubber layer and liquidation to occur. In order to validate the temperature rise suppression effect at the non-sheet feeding portion according to the present invention, the heater heating temperature was set to 220 degrees. 150,000 LTR longitudinal-sized sheets (75 g/mm$^2$) underwent sheet feeding at 50 sheets per minute. The ASKER-C hardness in the temperature rise occurring portion at the non-sheet feeding portion of the pressure roller was measured. Based on the measurement result on the ASKER-C hardness of the pressure roller which has already carried out sheet feeding of 150,000 sheets, the temperature rise suppression effect at the non-sheet feeding portion was assessed.

In the table 1, the entries in which the hardness drops within the range of not more than 3 degrees are marked by ◎. The entries in which the hardness drops within the range of 3 to 5 degrees are marked by ○. The entries in which one of destruction and liquidation occurs are marked by X. In the present invention, in the case where the decrease in hardness falls within the range of 5 degrees it is determined that the temperature rise suppression effect at the non-sheet feeding portion is present. In particular, in the case where decrease in hardness falls within the range of 3 to 5 degrees, it is determined that the temperature rise suppression at the non-sheet feeding portion is attained sufficiently.

<Conveyability>

A conveyability assessment was performed at the time when a LTR longitudinal-sized sheet (75 g/m$^2$), which was sufficiently neglected and has undergone moisture absorption in an environment of high temperature and high moisture (32°

C./80%) is shifted to the print state from the state where the fixing apparatus is sufficiently cool, in other words, at the time when 20 sheets are brought into continuous sheet feeding with the heater whose heating temperature was set to 220 degrees from the normal temperature state.

In the table 1, the entries with good conveyability are marked by ○. The entries with a conveyance failure so that a jam occurred are marked by X. For the embodiment roller 1, the thermal conductivity in the y direction was 2.55 W/(m·k). The temperature at non-sheet feeding portion was 290.5° C. so that the temperature rise suppression effect will be seen. Therefore, endurance (hardness) was also good. The film center portion surface temperature not being the non-sheet feeding portion was 205 degrees at the above described time. In the case of any embodiment roller, since the temperature in the film center portion was the same 205 degrees as the film center portion temperature of the embodiment roller 1, the description thereof will be omitted. On the other hand, the ASKER-C hardness was 17 degrees and has sufficient softness. In addition, since the solid rubber layer was formed on the outer periphery of core metal, conveyability was good.

For the embodiment roller 2, the fiber length and the thermal conductivity of the carbon fiber to be dispersed are like the fiber length and carbon-file conductivity of the embodiment roller 1. The dispersed content amount was increased to 25%. The thermal conductivity in the y direction was 10.67 W/(m·k), being larger than the thermal conductivity of the embodiment roller 1. The ASKER-C hardness was increased as well to attain 27 degrees, which nevertheless provides sufficient softness. The temperature at the non-sheet feeding portion was 272.5° C. A high temperature rise suppression effect was seen. As a result, endurance (hardness) was also good. In addition, conveyability was also good.

For the embodiment roller 3, the fiber length and the thermal conductivity of the carbon fiber to be dispersed are like the fiber length and carbon-file thermal conductivity of the embodiment roller 1. The dispersed content amount was increased to 35%. The thermal conductivity in the y direction was 39.22 W/(m·k), which is much higher than the thermal conductivity of the embodiment roller 1. The ASKER-C hardness was increased as well, to attain 39 degrees, which nevertheless provides sufficient softness. The temperature at the non-sheet feeding portion was 256.2° C. An extremely high temperature rise suppression effect was seen. As a result, endurance (hardness) was also good. In addition, conveyability was also good.

For the embodiment roller 4, the A/B proportion of the addition hardening type silicone rubber source liquid was adjusted to attain A/B=0.5 as compared to the embodiment roller 3, to enhance the degree of cross-linkage. Therefore, the ASKER-C hardness was 60 degrees, which was high. The softness gave rise to no problem for forming the solid rubber elastic layer. As for the thermal conductivity, the thermal conductivity in the y direction was 38.15 W/(m·k), being extremely high like the embodiment roller 3. The temperature at the non-sheet feeding portion was 257.1° C. and an extremely high temperature rise suppression effect was seen. As a result, endurance (hardness) was also good. In addition, conveyability was also good.

For the embodiment roller 5, the base rubber viscosity was reduced and the content amount of dispersed carbon fiber was enhanced to reach 40 vol %. Accordingly thermal conductivity in the y direction was 85.67 W/(m·k), being extremely high. The temperature at the non-sheet feeding portion was 247.7° C. An extremely high temperature rise suppression effect was seen. As a result, endurance (hardness) was also good. ASKER-C hardness is 47 degrees, which provides sufficient softness as well. For the embodiment roller 5, the base rubber viscosity was reduced and, therefore, the decrease in hardness was slightly large, but fell within a range giving rise to no problem. In addition, conveyability was also good. For molding, it should be noted that it was difficult to disperse and contain carbon fiber at more than 40 vol %.

For the embodiment roller 6, the fiber length of carbon fiber to be dispersed was changed from 50 μm to 150 μm in the embodiment roller 1. With the dispersed content amount at 15 vol %, the thermal conductivity in the y direction was 7.66 W/(m·k), which is larger than the thermal conductivity in the y direction of the embodiment roller 1. The ASKER-C hardness was also 20 degrees, which provides sufficient softness. The temperature rise suppression effect at the non-sheet feeding portion was high. As a result, endurance (hardness) was also good. In addition, conveyability was also good.

For the embodiment roller 7, the carbon fiber dispersed content amount was increased to reach 30 vol % compared to the embodiment roller 6. The thermal conductivity in the y direction was 65.78 W/(m·k), which is extremely high. The ASKER-C hardness was 35 degrees and provides sufficient softness. The temperature rise suppression effect at the non-sheet feeding portion was high. As a result, endurance (hardness) was also good. In addition, conveyability was also good.

For the embodiment roller 8, the base rubber viscosity was reduced in comparison to the embodiment roller 6 and the content amount of dispersed carbon fiber was enhanced to reach 35 vol %. The thermal conductivity in the y direction was 117.2 W/(m·k), which is the highest among the embodiment rollers 1 to 18. The ASKER-C hardness was 42 degrees, which provides sufficient softness as well. The temperature at the non-sheet feeding portion was 244.2° C. An extremely high temperature rise suppression effect was seen. For the embodiment roller 8, the base rubber viscosity was reduced and, therefore, the decrease in hardness was slightly large, but endurance (hardness) also fell within a range giving rise to no problem due to the extremely high temperature rise suppression effect. In addition, conveyability was also good.

For the embodiment roller 9, the fiber length of carbon fiber to be dispersed was selected to be 250 μm, which is slightly long. The other configurations of the roller are like the embodiment roller 1. Compared with the embodiment roller 1 with the same carbon fiber dispersed content amount being 15 vol %, the thermal conductivity in the y direction was 9.96 W/(m·k), which is large. The ASKER-C hardness was also 24 degrees, which provides sufficient softness. The temperature rise suppression effect at the non-sheet feeding portion was high. As a result, endurance (hardness) was also good. In addition, conveyability was also good.

For the embodiment roller 10, the carbon fiber dispersed content amount was increased to reach 25 vol % as compared to the embodiment roller 9. The thermal conductivity in the y direction was 41.6 W/(m·k), which is extremely high. The ASKER-C hardness was 34 degrees and provides sufficient softness as well. The temperature rise suppression effect at the non-sheet feeding portion was high. As a result, endurance (hardness) is also good. In addition, conveyability was also good.

For the embodiment roller 11, the base rubber viscosity was reduced as compared to the embodiment roller 10 and the content amount of dispersed carbon fiber was enhanced to reach 30 vol %. The thermal conductivity in the y direction was 80.23 W/(m·k), which is extremely high. The ASKER-C hardness was 39 degrees, which provides sufficient softness as well. The temperature at the non-sheet feeding portion was 248.2° C. An extremely high temperature rise suppression effect was seen. For the embodiment roller 11, the base rubber viscosity was reduced like the embodiment roller 8 and, therefore, the decrease in hardness was slightly large, but endurance (hardness) fell within a range giving rise to no problem due to the extremely high temperature rise suppression effect. In addition, conveyability was also good.

For the embodiment roller 12, the fiber length of carbon fiber to be dispersed was selected to be 500 μm, which is long. The dispersed content amount was 5 vol %. The other configurations of the roller are like the embodiment roller 1. The dispersed content amount was 5 vol %. The thermal conductivity in the y direction was 3.56 W/(m·k). The ASKER-C hardness was 29 degrees, which provides sufficient softness as well. The temperature at the non-sheet feeding portion was 286.8° C. A temperature rise suppression effect was seen. As a result, endurance (hardness) was also good. In addition, conveyability was also good.

For the embodiment roller 13, the carbon fiber dispersed content amount was increased to reach 15 vol % as compared to the embodiment roller 12. The thermal conductivity in the y direction was 21.44 W/(m·k), which is high. The ASKER-C hardness was 34 degrees, and provides sufficient softness as well. The temperature rise suppression effect at the non-sheet feeding portion was high. As a result, endurance (hardness) was also good. In addition, conveyability was also good.

For the embodiment roller 14, the base rubber viscosity was reduced as compared to the embodiment roller 13 and the content amount of the dispersed carbon fiber was enhanced to reach 25 vol %. The thermal conductivity in the y direction was 89.6 W/(m·k) which is extremely high. The ASKER-C hardness was 44 degrees, which provides sufficient softness as well. The temperature at the non-sheet feeding portion was 247.2° C. An extremely high temperature rise suppression effect was seen. For the embodiment roller 14, the base rubber viscosity was reduced like the embodiment roller 8 and, therefore, the decrease in hardness is slightly large but endurance (hardness) fell within a range giving rise to no problem due to extremely high temperature rise suppression effect. In addition, conveyability was also good.

For the embodiment roller 15, the fiber length of carbon fiber to be dispersed was selected to be 1 mm, which is rather long. The dispersed content amount was 5 vol %. The other configurations of the roller are like the embodiment roller 1. The thermal conductivity in the y direction was 6.35 W/(m·k), even with the dispersed content amount being 5 vol %. The ASKER-C hardness was 49 degrees, which provides sufficient softness as well. The temperature at the non-sheet feeding portion was 278.9° C. A temperature rise suppression effect was seen. As a result, endurance (hardness) was also good. In addition, conveyability was also good.

For the embodiment roller 16, the carbon fiber dispersed content amount was increased to reach 15 vol % as compared to the embodiment roller 15. The thermal conductivity in the y direction was 38.3 W/(m·k), which is high. The ASKER-C hardness was 55 degrees and provides sufficient softness as well. The temperature rise suppression effect at the non-sheet feeding portion was high. Endurance (hardness) was also good. In addition, conveyability was also good.

For the embodiment roller 17, the thermal conductivity $\lambda_f$ of the carbon fiber itself was set to 500 W/(m·k) and the fiber length of 150 μm which is slightly longer was used. The thermal conductivity in the y direction at the time when the dispersed content amount was 15 vol % is 4.26 W/(m·k). The ASKER-C hardness was 20 degrees and provides sufficient softness as well. The temperature at the non-sheet feeding portion was 284.4° C. A temperature rise suppression effect was seen. As a result, endurance (hardness) was also good. In addition, conveyability was also good.

For the embodiment roller 18, the carbon fiber dispersed content amount was increased to reach 30 vol % as compared to the embodiment roller 17. The thermal conductivity in the y direction was 37.89 W/(m·k), which is high. The ASKER-C hardness was 35 degrees and provides sufficient softness as well. The temperature at the non-sheet feeding portion was 257.1° C. and the temperature rise suppression effect at the non-sheet feeding portion was high. As a result, endurance (hardness) was also good. In addition, conveyability was also good.

In short, all the embodiment rollers 1 to 18 provide a temperature rise suppression effect at the non-sheet feeding portion. As a result, endurance (hardness) was also good. In addition, conveyability was also good. In addition, since a solid rubber elastic layer is formed on the periphery of the core metal, the endurance was improved.

For the comparative roller 19, since thermal conductivity of the solid rubber elastic layer was around 0.4 W/(m·k), the temperature at the non-sheet feeding portion was 311.2° C. which is high. A film surface layer and the fluororesin layer on the surface layer of the comparative roller 1 were melted. In addition, liquidation of the rubber layer of the comparative roller 19 was seen. In other words, the assessment on endurance (hardness) was X. Conveyability was good.

For the comparative roller 20, the conductivity in the y direction was 2.48 W/(m·k), but the temperature at non-sheet feeding portion was 295.6° C. and a temperature rise suppression effect was seen. On the other hand, hardness was 17 degrees which provides sufficient softness. However, since the solid rubber elastic layer was replaced and foamed sponge was formed, endurance is low. The foamed sponge layer was broken at the time point when approximately 80,000 sheets had undergone sheet feeding. As a result, in spite of presence of the temperature rise suppression effect, the assessment on endurance (hardness) was X. Conveyability was good.

For the comparative roller 21, the thermal conductivity in the y direction was 6.52 W/(m·k) and thermal conductivity in the x direction was 4.23 W/(m·k). For the comparative roller 21, the carbon fiber is dispersed and contained in the entire layer of the elastic layer stacked on the outer periphery of the core metal so that a sufficient value of thermal conductivity was provided. As a result, the temperature at the non-sheet feeding portion was 273.2° C. A high temperature rise suppression effect was obtained. However, the degree of orientation in the longitudinal direction of the carbon fiber was decreased. Y/x, being the proportion of the thermal conductivity in the y direction to the thermal conductivity in the x direction of the comparative roller 21, was lower than in the embodiment rollers 1 to 18. Consequently, heat will be allowed to get out in any direction of thickness of the core metal so that the roller surface temperature is likely to get low. In the case where a fixing device starts printing from the normal temperature state, the temperature on the pressure roller surface does not rise, but steam occurring at the time when the recording material passes the heating nip formed dew on the pressure roller surface. Consequently, a conveyability jam occurred in the comparative roller 21 to destabilize conveyance of the recording material. In short, the assessment on conveyability was X.

In other words, in the configuration of the comparative rollers 19 to 21, at least one of temperature rise suppression at the non-sheet feeding portion, assurance of endurance (hardness) and assurance of conveyability did not reach an acceptable level.

Figure 9:
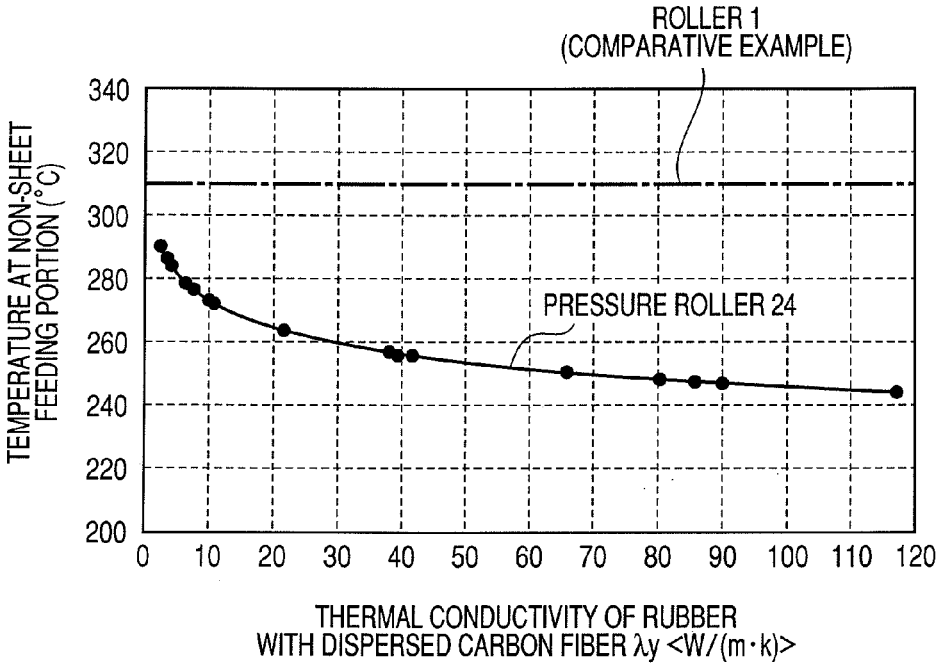
FIG. 9 is a graph illustrating the relation between thermal conductivity and temperature in non-sheet feeding portion of rubber layers of embodiment rollers 1 to 18.
Figure 10:
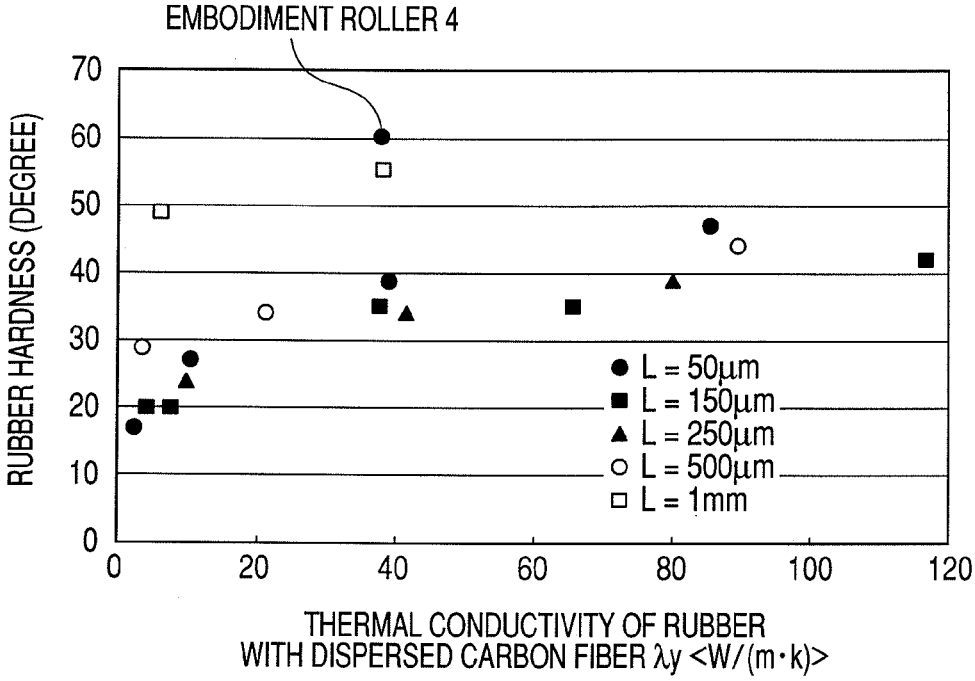
FIG. 10 is a graph illustrating the relation between thermal conductivity and rubber hardness of rubber layers of embodiment rollers 1 to 18.

FIG. 9 is a graph on a relation between the thermal conductivity $\lambda_y$ of the rubber layers of the above described embodiment rollers 1 to 18 and the temperature at the non-sheet feeding portion. FIG. 10 is a graph 2 on the relation between the thermal conductivity $\lambda_y$ of the rubber layer and the rubber hardness.

For the pressure roller 24 of the present embodiment, a highly thermal conductive filler in thin fiber shape (spicla) is used to provide a thermal conductivity $\lambda_y$ in the direction (y direction) perpendicular to the recording material conveyance direction of the highly thermal conductive elastic rubber layer 24*b* of $\lambda_y \geqq 2.5$ W/(m·k). As a result, as is apparent from FIG. 9, approximately 20 degrees better than the comparative roller 1 in temperature rise suppression effect was seen. Moreover, while attaining $\lambda_y \geqq 2.5$ W/(m·k), the ASKER-C hardness of the highly thermal conductive elastic rubber layer 24*b* was set to not more than 60 degrees (embodiment roller 4 illustrated in FIG. 10). As a result, together with the above described temperature rise suppression effect, nip forming with the pressure roller is not disturbed, but sufficient fixing performance can be secured.

Moreover, the solid rubber elastic layer is formed on the outer periphery of the core metal. Since a layer containing filler is formed on the outer periphery of the solid rubber elastic layer, the temperature rise suppression effect at the non-sheet feeding portion and endurance (hardness) are all good. In addition, conveyability will be able to become good.

In addition, for the pressure roller 24 of the present embodiment, a high temperature rise suppression effect, which attained a temperature lower than the temperature of the comparative roller 1 so as to exceed about 35 degrees in temperature difference, was seen as illustrated in FIG. 9, with the thermal conductivity $\lambda_y$ being not less than $\lambda_y \geqq 10$ W/(m·k). Moreover, while attaining $\lambda_y \geqq 10$ W/(m·k), the ASKER-C hardness of the highly thermal conductive elastic rubber layer 24*b* is set to not more than 55 degrees. As a result, together with the above described temperature rise suppression effect, nip forming with the pressure roller is not disturbed, but sufficient fixing performance can be secured. In addition, as apparent from FIG. 10, even if the thermal conductivity $\lambda_y$ in the y direction of the highly thermal conductive elastic rubber layer 24*b* is the same, the ASKER-C hardness is apparently higher as the fiber length of the carbon fiber is longer. In other words, in the case where the carbon fiber 24*f* is contained in the heat resistant elastic material 24*e*, the carbon fiber 24*f* with an approximate fiber length may be dispersed as described in the present embodiment. As a result, in the pressure roller 24, the above described case is apparently suitable for maintaining softness of the entire elastic layer (solid rubber elastic layer 24*a*+highly thermal conductive elastic rubber layer 24*b*) (establishment of low hardness). In order to secure the desired nip width, for the hardness of the solid rubber elastic layer, the ASKER-C hardness can fall within 65 degrees.

(5) Others 5-1) For the fixing apparatus 6 of a film heating system in the above described embodiment, the heater 22 will not be limited to the ceramic heater. For example, the heater can be selected from the group consisting of a contact heating body with a nichrome wire and electromagnetic induction heating member, such as an iron plate. The heater 22 does not necessarily have to be located in the nip portion N.

A heating fixing apparatus of an electromagnetic induction heating type can be obtained by film 23 itself being an electromagnetic induction heating metal film.

The film 23 can be configured to provide an apparatus which is driven to rotate with a driving roller by hanging the film 23 to bridge a plurality of hanging members. In addition, the film 23 can be a long member with ends to be rolled on the reel-out shaft and be configured to provide an apparatus which runs to move to a side of a reeling shaft.

5-2) As a heating member of the fixing apparatus, a fixing roller heated by one of halogen heater and ceramic heater can be used.

5-3) The image heating apparatus will not be limited to the fixing apparatus 6 of the embodiment but can be selected from the group consisting of an image heating apparatus temporarily fixing an unfixed image borne by recording material and an image heating apparatus which improves a surface property, such as gloss, by reheating the recording material bearing the image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2007-167477, filed Jun. 26, 2007 and 2008-162559, filed Jun. 20, 2008, which are hereby incorporated by reference herein in their entirety.

What is claimed is:

1. A roller used for an image heating apparatus, comprising:

a metal core;

an elastic layer containing a thermal conductive filler whose average length is not less than 0.05 mm and not more than 1 mm, wherein a thermal conductivity ($\lambda_f$) of the thermal conductive filler in the longitudinal direction of the thermal conductive filler is not less than 500 W/(m·k), wherein a dispersed amount of the thermal conductive filler dispersed in the elastic layer is not less than 5 vol % and not more than 40 vol %, wherein the thermal conductivity ($\lambda_y$) of the elastic layer in an axial direction of the roller is not less than 2.5 W/(m·k); and, a solid rubber layer provided between the metal core and the elastic layer, wherein a thermal conductivity ($\lambda$) of the solid rubber layer in a thickness direction of the solid rubber layer is not less than 0.16 W/(m·k) and not more than 0.40 W/(m·k).

2. A roller according to claim 1, wherein the dispersed amount of the thermal conductive filler is not less than 15 vol % and not more than 40 vol % and the thermal conductivity ($\lambda_y$) of the elastic layer in the axial direction of the roller is not less than 10 W/(m·k).

3. A roller according to claim 1, wherein the roller has a mold-releasing layer at a surface of the roller.

4. An image heating apparatus for heating an image formed on a recording material, comprising:

a heating member that heats the image formed on the recording material; and a roller that forms a nip portion in cooperation with the heating member, wherein the recording material is conveyed in the nip portion, the roller comprising:

a metal core;

an elastic layer containing a thermal conductive filler whose average length is not less than 0.05 mm and not more than 1 mm, wherein a thermal conductivity ($\lambda_f$) of the thermal conductive filler in the longitudinal direction of the thermal conductive filler is not less than 500 W/(m·k), wherein a dispersed amount of the thermal conductive filler dispersed in the elastic layer is not less than 5 vol % and not more than 40 vol %, wherein the thermal conductivity ($\lambda_y$) of the elastic layer in an axial direction of the roller is not less than 2.5 W/(m·k); and, a solid rubber layer provided between the metal core and the elastic layer, wherein a thermal conductivity (λ) of the solid rubber layer in a thickness direction of the solid rubber layer is not less than 0.16 W/(m·k) and not more than 0.40 W/(m·k).

5. An image heating apparatus according to claim 4, wherein the dispersed amount of thermal conductive filler is not less than 15 vol % and not more than 40 vol % and the thermal conductivity ($\lambda_y$) of the elastic layer in the axial direction of the roller is not less than 10 W/(m·k).

6. An image heating apparatus according to claim 4, wherein the roller has a mold-releasing layer at a surface of the roller.

7. An image heating apparatus according to claim 4, wherein the heating member includes a cylindrical film.

8. An image heating apparatus according to claim 7, wherein the heating member includes a heater that contacts an inside of the cylindrical film, wherein the nip portion is formed by the heater and the roller through the cylindrical film.

9. A roller used for an image heating apparatus, comprising:

a metal core;

an elastic layer containing a pitch-based carbon fiber, wherein a dispersed amount of the pitch-based carbon fiber dispersed in the elastic layer is not less than 5 vol % and not more than 40 vol %, wherein the thermal conductivity ($\lambda_y$) of the elastic layer in an axial direction of the roller is not less than 2.5 W/(m·k); and, a solid rubber layer provided between the metal core and the elastic layer, wherein a thermal conductivity (λ) of the solid rubber layer in a thickness direction of the solid rubber layer is not less than 0.16 W/(m·k) and not more than 0.40 W/(m·k).

10. A roller according to claim 9, wherein the dispersed amount of the pitch-based carbon fiber is not less than 15 vol % and not more than 40 vol % and the thermal conductivity (λy) of the elastic layer in the axial direction of the roller is not less than 10 W/(m·k).

11. A roller according to claim 9, wherein the roller has a mold-releasing layer at a surface of the roller.

12. An image heating apparatus for heating an image formed on a recording material, comprising:

a heating member that heats the image formed on the recording material; and a roller that forms a nip portion in cooperation with the heating member, wherein the recording material is conveyed in the nip portion, the roller comprising:

a metal core;

an elastic layer containing a pitch-based carbon fiber, wherein a dispersed amount of the pitch-based carbon fiber dispersed in the elastic layer is not less than 5 vol % and not more than 40 vol %, wherein the thermal conductivity ($\lambda_y$) of the elastic layer in an axial direction of the roller is not less than 2.5 W/(m·k); and a solid rubber layer provided between the metal core and the elastic layer, wherein a thermal conductivity (·) of the solid rubber layer in a thickness direction of the solid rubber layer is not less than 0.16 W/(m·k) and not more than 0.40 W/(m·k).

13. An image heating apparatus according to claim 12, wherein the dispersed amount of pitch based carbon fiber is not less than 15 vol % and not more than 40 vol % and the thermal conductivity ($\lambda_y$) of the elastic layer in the axial direction of the roller is not less than 10 W/(m·k).

14. An image heating apparatus according to claim 12, wherein the roller has a mold-releasing layer at a surface of the roller.

15. An image heating apparatus according to claim 12, wherein the heating member includes a cylindrical film.

16. An image heating apparatus according to claim 15, wherein the heating member includes a heater that contacts an inside of the cylindrical film, wherein the nip portion is formed by the heater and the roller through the cylindrical film.

* * * * *